US005125169A

United States Patent [19]

Bader

[11] Patent Number: 5,125,169

[45] Date of Patent: Jun. 30, 1992

[54] GLOVE DRYING APPARATUS AND METHOD

[75] Inventor: Michael F. Bader, Redmond, Wash.

[73] Assignee: Protonaut, Inc., Mercer Island, Wash.

[21] Appl. No.: 715,906

[22] Filed: Jun. 14, 1991

[51] Int. Cl.[5] ..... F26B 25/00

[52] U.S. Cl. ..... 34/103; 34/104; 34/239; 34/21; 223/78; 223/80

[58] Field of Search ..... 34/104, 103, 151, 243 R, 34/239, 21, 106; 223/78, 79, 80, 52; 248/309.1

[56] References Cited

U.S. PATENT DOCUMENTS

| | | | |
|---|---|---|---|
| 907,137 | 12/1908 | Fenohr | 223/78 |
| 1,736,679 | 11/1929 | Tierney | 223/78 |
| 1,997,921 | 4/1935 | Bliss | 223/80 |
| 2,134,974 | 11/1938 | Hurwitz | 223/78 |
| 2,462,632 | 2/1949 | Givoni | 223/80 |
| 3,166,439 | 1/1965 | Dennhofer | 223/78 |
| 4,018,382 | 4/1977 | Dicuya | 223/78 |
| 4,209,913 | 7/1980 | Wallin et al. | 34/21 |
| 4,689,897 | 9/1987 | Marsalona | 34/104 |
| 4,697,724 | 10/1987 | Pitcher | 223/78 |

FOREIGN PATENT DOCUMENTS

| | | | |
|---|---|---|---|
| 161674 | 7/1905 | Fed. Rep. of Germany | 223/78 |
| 236618 | 8/1910 | Fed. Rep. of Germany | 223/80 |
| 714171 | 11/1931 | France | 223/78 |

*Primary Examiner*—Henry A. Bennet
*Assistant Examiner*—Denise L. Gromada
*Attorney, Agent, or Firm*—Seed and Berry

[57] ABSTRACT

A glove drying apparatus has five fingers which are angularly movable with respect to one another. A sliding mechanism is actuated to move the fingers between a relatively closed position in which the apparatus can be readily inserted into a glove. The sliding mechanism is then actuated once inside the glove to expand the fingers into a glove drying position. After the glove has been thoroughly dried, the sliding mechanism is again actuated to retract the fingers to facilitate the removal of the glove drying apparatus from a glove.

14 Claims, 3 Drawing Sheets

FIG. 3
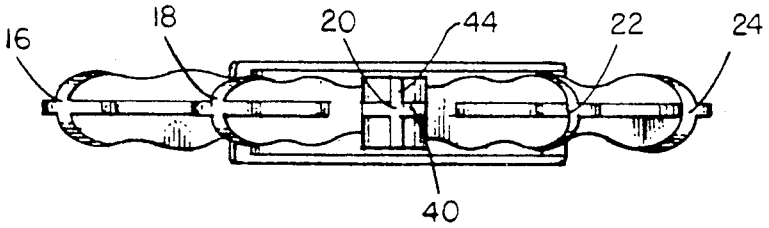
FIG. 4
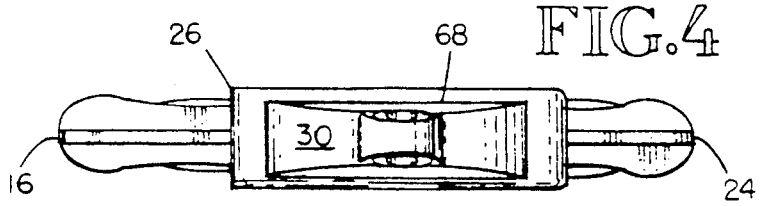
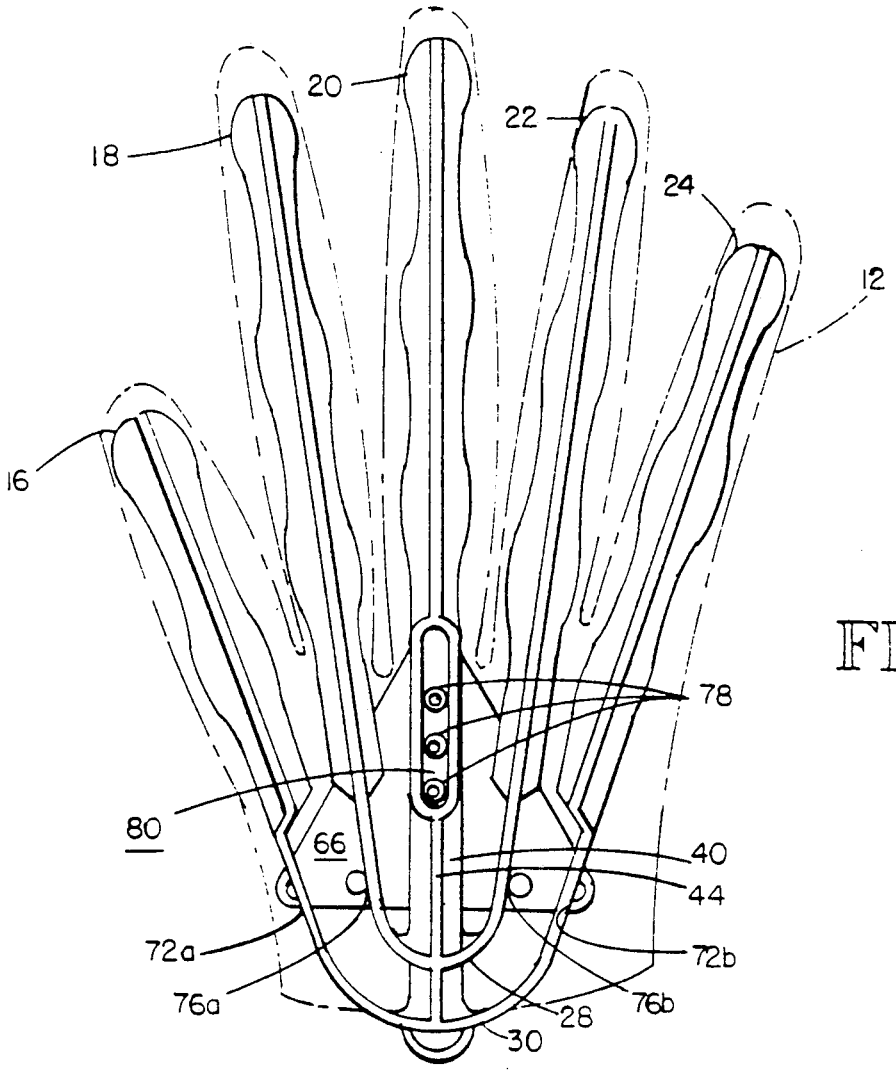
FIG. 5

FIG.6
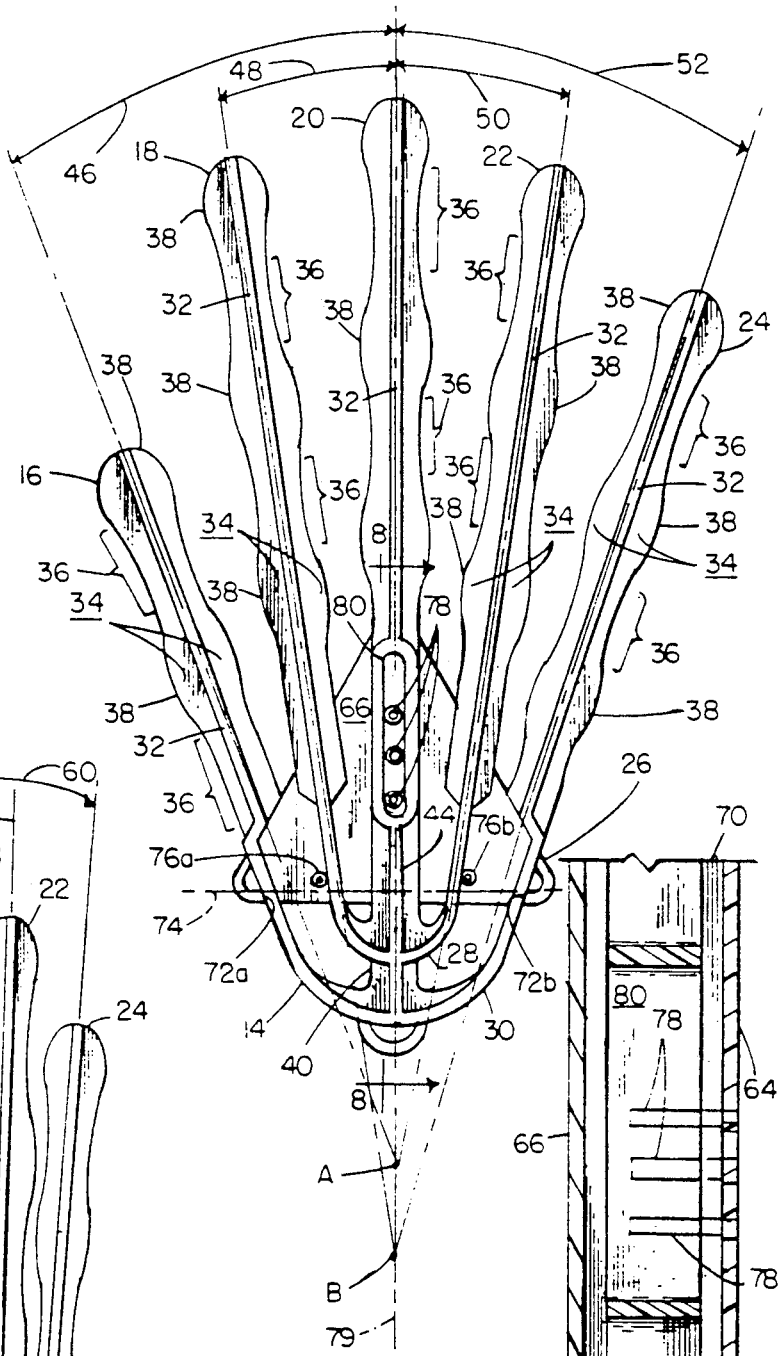
FIG.7
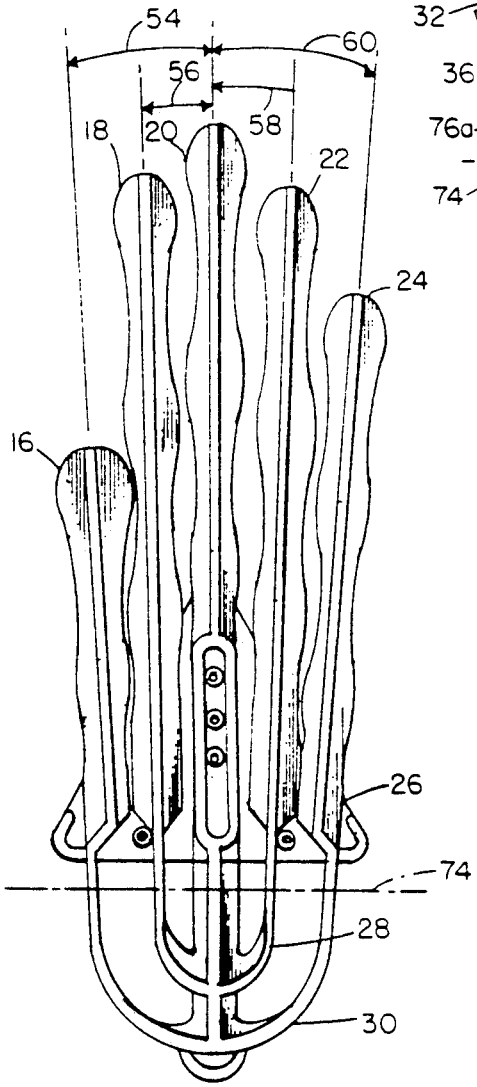
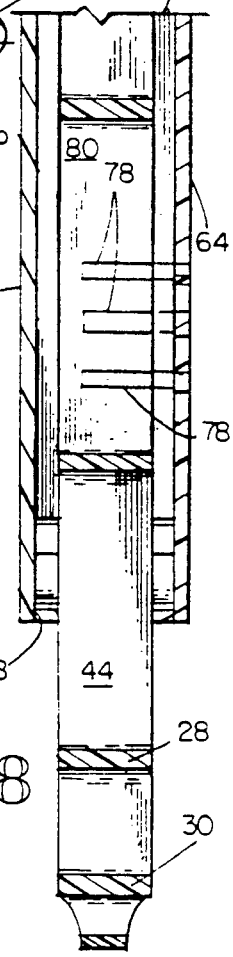
FIG.8

GLOVE DRYING APPARATUS AND METHOD

DESCRIPTION

1. Technical Field

The invention relates to drying apparatus. More specifically, the invention relates to racks and frames for drying wet articles such as gloves and the like.

2. Background of the Invention

Modern sports enthusiasts employ a variety of gloves having different constructions to improve their enjoyment of various sports. The players in sports such as golf, racquetball, and the like advantageously employ thin gloves manufactured from high-quality supple leathers to improve frictional engagement between the player's hand and the grip of the appropriate sporting product, such as the golf club or racquetball racket. These gloves may become saturated with sweat (as in the case of the racquetball player) or soaked by rain (such as in the case of a golf player). Both of these conditions disadvantageously subject the glove to drying in an unnatural position after the glove is removed. This unnatural position then becomes "memorized" by the glove as the glove dries in the bottom of a locker, golf club bag or the like. When the player next wears the same glove, the glove may be rigid and uncomfortable to wear. This loss of suppleness may adversely affect the athlete's play and also the useful life of the glove itself.

Other sports enthusiasts such as skiers employ gloves not only to improve grip on ski poles and the like, but also to insulate the wearer from the cold. These gloves may become water saturated due to the snow conditions in which they are used. After use, these gloves are typically left to dry in various positions which do not appropriately model the shape of the human hand. These gloves may become embrittled in such an unnatural position so that subsequent use by the athlete results in cracking and premature aging of the glove. In addition, the lack of adequate air circulation within the glove may result in the glove never becoming thoroughly dry before its next use. This result is not only uncomfortable for the wearer and reduces the effectiveness of the glove's function, but promotes rotting of the glove material and subsequent early failure of the glove.

Therefore, a need exists for a method and apparatus which facilitates thorough and relatively rapid drying of a glove, and which promotes drying of the glove into a shape which closely models the natural position of the human hand.

SUMMARY OF THE INVENTION

It is therefore an object of the present invention to provide a glove drying apparatus which promotes thorough and rapid drying of a glove.

It is yet another object of the present invention to achieve the above objects with an apparatus which is mechanically simple and inexpensive to manufacture.

It is a further object of the present invention to provide a glove drying apparatus which dries the glove in an anatomically natural position so as to avoid undesirable deformation of the glove.

The invention achieves these objects, and other objects and advantages which will become apparent from the description which follows by providing a frame having five fingers, each of which corresponds to a thumb, index finger, middle finger, fourth finger, and fifth finger of a human hand. The first, second, fourth, and fifth fingers are arcuately movable with respect to the third (middle) finger. A movable control device controls arcuate movement of the first, second, fourth, and fifth fingers with respect to the third (middle) finger so that the fingers can be collapsed (i.e., the fingers closed together) to facilitate insertion of the device into a glove. After the device has been inserted into the glove, the control mechanisms is actuated to spread the fingers apart to laterally, arcuately extended position which spread out the fingers of the glove. The glove thus dries in an anatomically natural position for a human hand.

In its preferred embodiment, the control mechanism engages the fingers in a reciprocal sliding motion. The fingers are also provided with a plurality of orthoganol, transverse webs which promote longitudinal air flow inside of the glove. The fingers can also be provided with reduced diameter sections, and enlarged diameter sections wherein the enlarged diameter sections correspond to the longitudinal positions of knuckles and fingertips on the human hand so that relatively thin, leather gloves such as golf gloves, dry into a shape which closely conforms to that of a human hand.

After the glove has been thoroughly dried while the device is received within the glove, the sliding control mechanism is actuated to arcuately retract the fingers to facilitate removal of the apparatus from the dried glove.

BRIEF DESCRIPTION OF THE DRAWINGS

FIG. 3 is a front elevational view of the glove drying apparatus.

FIG. 4 is a rear elevational view of the glove drying apparatus.

FIG. 5 is a top plan view, with a portion of the invention cut away, with the invention shown inserted in a glove drawn in phantom.

FIG. 6 is a top plan view similar to FIG. 5, illustrating the angular relationship of the fingers of the hand when in a laterally, extended position.

FIG. 7 is a top plan view, similar to FIG. 6, showing the fingers of the glove drying apparatus in a laterally, retracted position such as prior to insertion of the device into a glove.

FIG. 8 is an enlarged, partial, sectional view of the glove drying apparatus taken along line 8—8 of FIG. 6.

DETAILED DESCRIPTION OF THE INVENTION

Figure 1:
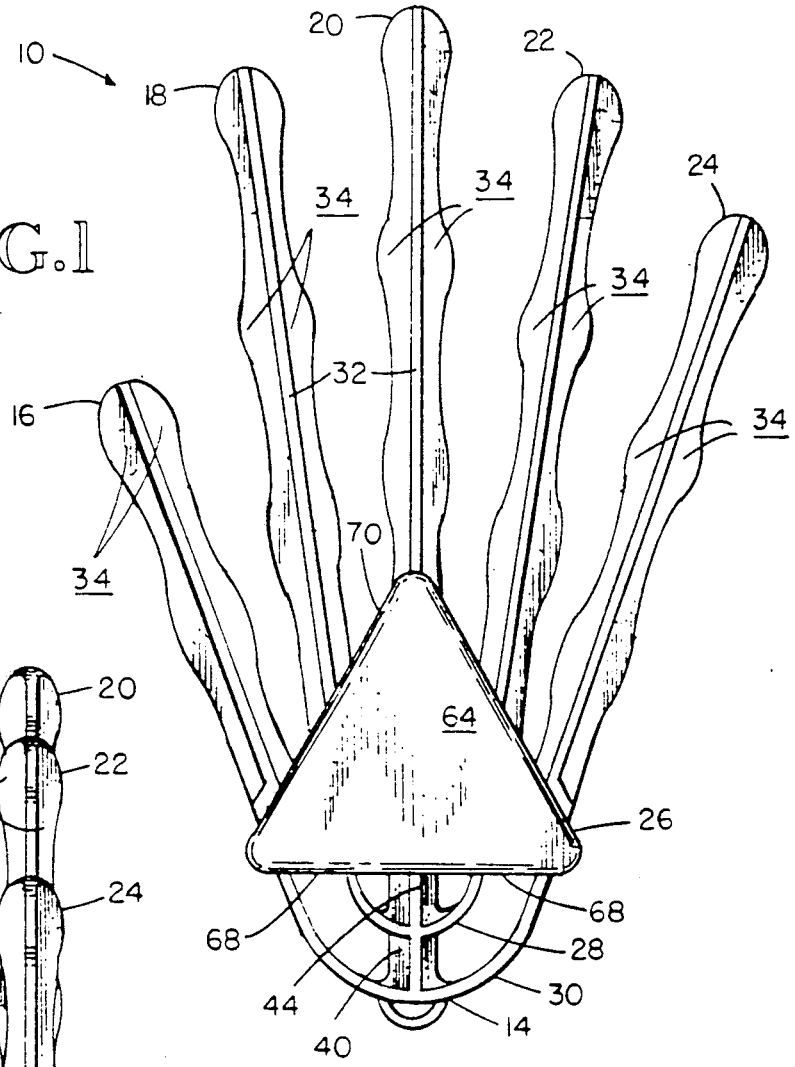
FIG. 1 is a top plan view of the glove drying apparatus of the present invention.
Figure 2:
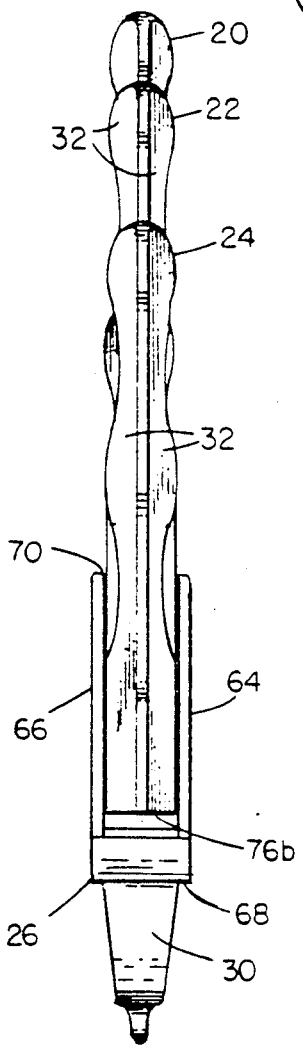
FIG. 2 is a side elevational view of the glove drying apparatus of FIG. 1.

A glove drying apparatus, in accordance with the principles of the invention, is generally indicated at reference numeral 10 in FIG. 1. The apparatus is useful for drying gloves, of the type generally indicated at reference numeral 12 and shown in phantom lines in FIG. 5. The apparatus includes a frame 14 having a first finger 16, a second finger 18, a third finger 20, a fourth finger 22, and a fifth finger 24, corresponding to a thumb, an index finger, a middle finger, a fourth finger, and a fifth finger of a typical human hand. The first finger 16, the second finger 18, the fourth finger 22, and the fifth finger 24 are arcuately pivotable with respect to the third finger 20 so that the fingers of the apparatus 10 are arcuately movable between a laterally extended position shown in FIGS. 1, 5, and 6, and a arcuately, laterally retracted position shown in FIG. 7. A reciprocally slidable control mechanism 26 controls the arcuate movement of the fingers between the extended and retracted positions. As shown in FIG. 5, the laterally extended position is used to promote thorough drying of the glove 12 while the arcuately retracted position shown in FIG. 7 is used to facilitate insertion of the apparatus 10 into the glove 12.

The frame 14 is integral with and includes the first through fifth fingers, and is preferably manufactured from a flexible, thermoplastic material such as polyethylene in a molding process such as injection molding. As best seen in FIGS. 5, 6, and 7, the frame includes an inner, substantially U-shaped flexible root portion 28 and a substantially U-shaped, outer flexible root portion 30. The first finger 16 and fifth finger 24 are connected to the root portion 28 and the second finger 18 and fourth finger 22 are connected to the outer root portion 30. Each finger has laterally extending webs 34 and front and back webs 32. These webs undulate in width commencing at the tips of the fingers for a major part of their length so as to have reduced dimension portions 36 16 and fifth finger 24 are formed by combining substantially transverse web portions 32 and 34 with the part of the outer, vertically oriented U-shaped outer web 30. In the vicinity of the fingers, the transverse web portions, and the adjacent portions of the U-shaped web are scalloped so as to have reduced dimension portions 36 and enlarged dimension portions 38. The reduced and enlarged dimensioned portions serve to model the cross-sectional dimension of human fingers at the approximate longitudinal location of the knuckles and fingertips wherein the human hand has enlarged dimensions, and at the areas in between wherein the human hand has reduced diameter portions respectively. This dimensional variation promotes drying of the glove into a shape which anatomically follows the contour of a human hand. In addition, the web design of the fingers encourages air flow therealong between the webs and also around the webs and thus promotes thorough and rapid drying of the glove. Such thorough and rapid drying is desirable to prevent rotting of the materials from which the gloves are made in addition to preparing the glove for reuse after a relatively short period of time. Third finger 20, and fourth finger 22 employ a similar scalloped construction as described hereinabove for the first finger 16 and fifth finger 24.

The third finger 20 has a transverse web portion 40 which extends the full length of the glove drying device 10. The third finger also has a front and back webs 44 which extends the full length of the glove drying device. The third finger 20 is therefore substantially rigid with respect to the first, second, fourth, and fifth fingers. The first, second, fourth and fifth fingers are thus relatively free to pivot with respect to the third finger 20 at the U-shaped root portions 28, 30. Furthermore, as the frame 14 is preferably molded from a substantially resilient, thermoplastic material as described above, the first, second, fourth, and fifth fingers are resiliently biased to the extended position shown in FIGS. 1, 5, and 6.

When in their rest position as shown in FIGS. 1, 5 and 6 the first, second, fourth, and fifth fingers have laterally extended, arcuate positions with respect to the third finger 20 of approximately 20.7°, 8.2°, 8.2°, and 18.67°, respectively. The sliding control mechanism 26 engages outer portions of the U-shaped webs 30, 32 so as to collapse the first, second, fourth, and fifth fingers into laterally collapsed, angular positions with respect to the third finger 20 of 18.05°, 7.4°, 7.4°, and 16.47°, respectively, as shown at reference numerals 54, 56, 58, and 60.

The slidable control mechanism 26 consists of upper and lower interfitting triangular plates 64, 66 suitably locked together. In FIGS. 5, 6, and 7, the upper plate 64 has been removed to illustrate the interaction between the lower portion 66 and the frame 14 which controls the arcuate movement of the fingers. The upper and lower triangular plates define a rearwardly directed opening 68 for receiving the U-shaped root portions 28, 30 of the frame, and a forwardly directed opening 70 for the fingers 16, 18, 20, 22 and 38. The triangular plates collectively provide at their rearward corners a first set of inwardly directed camming surfaces 72A and 72B which contact outer surfaces of the outer root portion 30. The distance between these camming surfaces 72A and 72B is approximately 2.374 inches.

A horizontal line between the first set of camming surfaces 72A, 72B defines a transverse reference line 74. A second set of inwardly directed camming surfaces 76A, 76B is provided by the plates 64, 66 located approximately 0.174 inch ahead of the reference line 74 and the first set of camming surfaces. The second set of camming surfaces is separated by a distance of approximately 1.279 inches so as to contact the outer side of the inner U-shaped root portion 28 when the control mechanism 26 is in the position shown in FIG. 6.

The mechanism 26 is capable of longitudinally advanceing and retracting approximately ½ inch by virtue of a pair of posts 77, 78 which are sized for reciprocal motion within an elongated aperture 80 presented by the third finger 20. A third hollow intermediate post 79 receives a clamping screw passing through the top plate 64. The elongated aperture 80 has an inside, longitudinal dimension which is approximately ½ inch longer than the distance between the distal sides of the posts 77, 78. The first and second set of camming surfaces 72A, 72B and 76A, 76B therefore are capable of forward, longitudinal movement a distance approximately equal to ½ inch. This longitudinal movement inwardly displaces the inner root 28 approximately 0.0035 inch on each side of a longitudinal axis 79 defined by the third finger 20 at the point of contact between the second set of camming surfaces and the web when the sliding mechanism 26 is moved forward fully. Similarly, the outer, U-shaped root 30 is displaced inwardly when the sliding mechanism is moved forwardly. The first finger moves inwardly a distance of approximately 0.0018 inch and the fifth finger moves inwardly a distance of approximately 0.05 inch at the point of contact between the first set of camming surfaces and the outer root when the sliding mechanism is fully forwardly activated. This results in the laterally retracted angular disposition of the fingers as shown in FIG. 7. Longitudinal retraction of the mechanism 26 results in the laterally expanded angular disposition of the fingers shown in FIG. 6.

As best seen in FIG. 6, the first finger 16 and the fifth finger 24 are angularly disposed to intersect at a point A projected approximately 3.51 inches behind reference line 74. The second and fourth fingers 18 and 22 are angularly positioned when in their relaxed state to intersect at a projected location B approximately 4.4378 inches behind reference line 74. From this same reference line, the first finger 16 has a preferred length when measured by a perpendicular projection from reference line 74 to the tip of the first finger 16 of 3.9 inches. The second finger 18 has a length of approximately 6.5 inches as does the fourth finger 22, the third finger 20 having a length of approximately 7 inches, and the fifth finger 24 has a length of approximately 5.25 when each is measured from the reference line 74 in a similar fashion.

The device 10 is used as follows. Initially, the control mechanism 26 is slid into its forward position as shown in FIG. 7. The device is then inserted into a glove 12 and the sliding mechanism 26 actuated in a rearward direction to spread apart the fingers as shown in FIG. 5. After the glove has thoroughly dried, the sliding mechanism 26 is again forwardly actuated as shown in FIG. 7 to collapse the fingers and permit easy removal of the apparatus from the glove. The rearward opening 68 and forward opening 70 of the sliding control mechanism 26 permit longitudinal air flow through the control mechanism and into the fingers of the glove drying apparatus and glove. These openings also permit the use of a forced air flow, such as from a hand-held hair dryer, to expedite the glove drying process.

Other embodiments and variations of the invention are contemplated. For example, while it is preferred to manufacture the frame 14 out of a resilient material so that the fingers are biased to the laterally extended position shown in FIG. 5, the frame could be molded so that the fingers have a rest position such as that shown in FIG. 7. The camming surfaces 72 and 76 could then be positioned on the sliding mechanism 26 so as to contact the inner sides of the U-shaped root portions 28, 30 so as to expand the fingers to their extended position when the control mechanism 26 is slid forward. In addition, the frame 14 could be constructed with a neutral bias while the sliding mechanism 26 engages both sides of the U-shaped root portions 28, 30 to positively move the fingers between the extended and retracted positions. This construction technique would not require any bias on the fingers at all. Further yet, the interconnection between the first, second, fourth and fifth fingers, and the relatively fixed third finger 20 could be manufactured from pivotable rather than flexible junctions with a positively engaged sliding mechanisms as described above. All of these alternate methods of construction, while functionally equivalent to that shown in the drawings and described hereinabove, would be more costly to produce and therefore are not considered to be as desirable as the preferred embodiment shown in the drawings. Nevertheless, materials and construction techniques which have yet to become available may render such alternate embodiments cost competitive with the preferred embodiment shown, and are therefore considered to be within the scope of this disclosure.

The invention is therefore not to be determined in scope by the above description, but rather by the claims which follow.

I claim:

1. A glove drying apparatus for insertion into a glove to promote thorough drying thereof and to avoid deformation thereof, comprising:

first through fifth, elongated fingers having front and back sides and lateral sides, and corresponding to a thumb, index finger, middle finger, fourth, and fifth fingers of a human hand, respectively, the third finger defining a longitudinal axis and the first, second, fourth and fifth fingers being relatively angularly movable with respect to the third finger between laterally extended and retracted positions;

bias means for biasing the first, second, fourth, and fifth fingers to the laterally extended positions; and control means for controlling the angular motion of the first, second, fourth, and fifth fingers with respect to the third finger, said control means being reciprocally and longitudinally movable over a limited distance and having a first set of cam surfaces positioned to engage the first and fifth fingers, the control means also having a second set of cam surfaces positioned to engage the second and fourth fingers, whereby longitudinal movement of the control means moves the first, second, fourth, and fifth fingers between said expanded and retracted positions.

2. The apparatus of claim 1 wherein the first, second, fourth, and fifth fingers are flexibly interconnected to the third finger and wherein the bias means includes a resilient material used in the construction of the fingers.

3. The apparatus of claim 1 wherein the fingers have substantially non-constant cross sections along the length thereof for air circulation within the fingers of a glove mounted thereon.

4. The apparatus of claim 3 wherein the nonconstant cross section of the fingers alternates between minimum and maximum dimensions at a plurality of longitudinal positions.

5. The apparatus of claim 4 wherein the longitudinal positions substantially correspond to longitudinal positions of knuckles and fingertips of a human hand.

6. The apparatus of claim 1 wherein the fingers have front, back and lateral longitudinal web structures at substantially right angles relative to each other to promote, longitudinal air flow within the glove.

7. The apparatus of claim 1 wherein said cam surfaces contact surfaces of the first, second, fourth, and fifth fingers which are directed laterally away from said third finger.

8. The apparatus of claim 1 wherein the first, second, fourth, and fifth fingers are disposed with respect to the third finger at retracted angular positions of approximately 20.7°, 8.2°, 8.2°, and 18.7° when the fingers are in their respective extended positions.

9. The apparatus of claim 8 wherein the limited distance over which the control means is moveable is approximately 0.5 inch and wherein the first, second, fourth, and fifth fingers assume extended angular positions of about 18°, 7.4°, 7.4°, and 16.5° when the fingers are in their respective, retracted positions.

10. A glove drying apparatus comprising:

an integral frame with front and back sides and providing first through fifth fingers having root ends and tip ends, said fingers corresponding to a thumb, index finger, middle finger, fourth and fifth fingers of a human hand, respectively, said frame having flexible root portions connecting the root ends of said first, second, fourth, and fifth fingers to a root end portion of said fifth finger, whereby said first and second fingers are laterally angularly movable relative to said third finger and one another, and said fourth and fifth fingers are also laterally angularly movable relative to said third finger and one another between laterally retracted and expanded positions, said fingers each having two lateral webs therealong extending in opposite lateral directions and having front and back webs therealong, some of said webs on each finger undulating in width between minimum and maximum dimensions so that air is free to circulate along said fingers between said webs and also at least part way around said fingers within a glove stretched over said fingers for drying.

11. Apparatus according to claim 10 in which all of said webs undulate in width between minimum and maximum dimensions.

12. Apparatus according to claim 10, in which said root portions comprise an outer generally U-shaped root portion connecting said first and fifth finger to said third finger, and an inner generally U-shaped root portion connecting said second and fourth fingers to said third finger.

13. Apparatus according to claim 12 in which said inner root portion is spaced toward the tip of said third finger from said outer root portion.

14. Apparatus according to claim 10 in which control means is mounted for sliding movement on said third finger and is arranged to engage the other fingers for moving them between said retracted and expanded positions responsive to said sliding movement.

* * * * *